United States Patent [19]

Walda et al.

[11] Patent Number: 4,776,735

[45] Date of Patent: Oct. 11, 1988

[54] LOCKING AND STIFFENING MEANS FOR A RAIL CAR WITH A ROTATABLE LOADING FLOOR

[76] Inventors: Fedde Walda, Leendert Sparreboomstraat 15; Nanne M. Walda, Leendert Sparreboomstr. 13, both of, 3078 JJ Rotterdam; Benne F. Walda, De Koumen 22, 6433 KD Hoensbroek, all of Netherlands

[21] Appl. No.: 105,487

[22] Filed: Sep. 30, 1987

Related U.S. Application Data

[63] Continuation of Ser. No. 882,544, Jul. 7, 1986, abandoned.

[30] Foreign Application Priority Data

Jul. 4, 1985 [NL] Netherlands ..... 8501911

[51] Int. Cl.[4] ..... B61J 1/00

[52] U.S. Cl. ..... 410/1; 104/45; 104/47; 104/37; 105/455

[58] Field of Search ..... 410/1; 104/35, 36, 41, 104/47, 48, 49, 99, 130, 45, 37; 105/455; 292/144, DIG. 55, DIG. 60

[56] References Cited

U.S. PATENT DOCUMENTS

| | | | |
|---|---|---|---|
| 984,967 | 2/1911 | Rasmus | 104/41 |
| 3,092,075 | 6/1963 | Hosokawa | 104/36 |
| 3,521,572 | 7/1970 | Hamilton | 410/1 X |
| 3,973,793 | 8/1976 | Hirst, Jr. et al. | 292/144 |
| 4,036,148 | 7/1977 | Jones et al. | 104/166 |
| 4,094,252 | 6/1978 | Pater et al. | 104/47 X |
| 4,132,439 | 1/1979 | Millar | 292/144 |
| 4,425,064 | 1/1984 | Walda et al. | 410/1 |

*Primary Examiner*—Robert B. Reeves
*Assistant Examiner*—Russell D. Stormer
*Attorney, Agent, or Firm*—Frishauf, Holtz, Goodman & Woodward

[57] ABSTRACT

A railroad flat car having a rotatable loading floor for transferring loads between it and a platform. A sleeve is provided in the rotatable loading floor which slidably receives a beam coupled to the chassis. The beam is extended into the sleeve to secure the loading floor in its stowed position during travel. The beam abuts against a steel plate in the sleeve to provide a solid buffer against horizontal motion of the rotatable loading floor along its longitudinal axis, the beam and sleeve also stiffen the rail car to minimize sagging under heavy loads. The end of the loading floor has a pinion gear which meshes with a toothed rack on the chassis. A motor turns the pinion gear to swing the rotatable loading floor into position.

7 Claims, 4 Drawing Sheets

LOCKING AND STIFFENING MEANS FOR A RAIL CAR WITH A ROTATABLE LOADING FLOOR

This application is a continuation of application Ser. No. 882,544, filed July 7, 1986, now abandoned.

BACKGROUND OF THE INVENTION

The present invention relates to the transport of freight by railroad using a rail car with a rotatable loading floor pivotally mounted to it for the quick loading and unloading of vehicles which can be rolled onto and off of the loading floor from a station platform located adjacent the side of the rail car and, more particularly, to structure for securing the rotatable loading floor in its stowed position during travel which stiffens the rail car for heavy loads and buffers the loading floor against horizontal movement in the longitudinal direction.

Various approaches have been utilized to facilitate the transfer of loads, such as vehicles, between rail cars and station platforms. As disclosed in U.S. Pat. No. 4,425,064 a rotatable loading floor is pivotally mounted onto the chassis of a rail car. When a train of such rail cars travels between stations, the loading floor is stowed with its longitudinal axis being aligned with the longitudinal axis of the rail car chassis. When the train arrives at a station platform, the rotatable loading floor is pivoted so that at least one of its ends rests on a station platform. Loads can then be transferred between the loading floor and station platform by, for example, rolling them, as with or on a vehicle.

When the train is in motion between stations, it is important to lock the rotatable loading floor in its stowed position. Otherwise, the jostling which occurs as a result of acceleration, deceleration, and rocking motion imparted by the tracks may cause the loading floor to swing outward. Serious damage and injury could then result.

To prevent this from happening, U.S. Pat. No. 4,425,064 discloses a locking pin secured to the chassis at either end of the loading floor and centered in the transverse direction. The locking pins fit into suitably sized openings in the loading floor. However, a strong car buffer is preferred to act against horizontal motion of the loading floor in the longitudinal direction. Also, heavy loads tend to cause the chassis to sag. The pin arrangement of this patent does not adequately "stiffen" the chassis to minimize this sag.

U.S. Pat. No. 3,916,799 discloses securing pins which slide vertically within openings in the loading platform. Sockets in the chassis are sized to receive these pins when the loading floor is in its stowed position. This arrangement is, however, deficient in adequately performing the "buffering" and "stiffening" functions mentioned above.

Another difficulty associated with prior art rail cars involves the motorized rotating means used to swing the loading floor to its operative position on the station platform. Various gearing mechanisms have been used to couple the motors to the loading floor. However, due to the arrangement used in these approaches, less than the optimal torque has been applied resulting in the inability to rotate the loading floor if it carries very heavy loads.

SUMMARY OF THE INVENTION

It is a general object of the present invention to provide an improved freight transport technique involving a rail car with a rotatable loading floor for transferring loads between a station platform and the rail car.

A more specific object of the present invention is to provide a rail with reliable means to secure the rotatable loading floor in its stowed position.

Another object of the present invention is to provide a rail car capable of adequately buffering the rotatable loading floor against horizontal motion in the longitudinal direction while in its stowed position.

A further object of the present invention is to provide a rail car which is stiffened against sagging of the chassis under very heavy loads borne by the rotatable loading floor while the floor is secured in its stowed position.

Yet another object of the present invention is to provide a rail car with a rotatable loading floor with improved means to rotate the loading floor even when it is laden with a very heavy load.

These and other objects of the invention are attained by a rail car for use with a station platform located on a longitudinal side of the rail car for transferring loads between the rail car and the station platform. The rail car includes a chassis supported by wheels. Part of the chassis is a deck coupled between chassis end portions. An elongated loading floor is pivotally mounted on the deck and is rotatable relative to the chassis in a substantially horizontal plane between first and second positions. In the first position, the longitudinal axis of the loading floor coincides with the longitudinal axis of the rail car. In the second position, at least one end of the loading floor overlies the station platform at the side of the rail car in operative association with the station platform for transferring a load between the loading floor and the station platform. Power means are provided for rotating the loading floor between said first and second positions. In accordance with a particular improvement provided by the invention, the rail car includes means to secure the loading floor to the chassis when the loading floor is in its first position, including a sleeve secured to one of the rotatable loading floor and at least one of the chassis end portions. The sleeve has its axis parallel to the longitudinal axis of the rail car when the rotatable loading floor is in its first position. A beam is slidably mounted to the other of the rotatable loading floor and at least one of the chassis end portions. The beam has its axis substantially coinciding with the sleeve axis when the rotatable loading floor is in its first position. The beam is sized to slidably fit into the sleeve. A power means moves the beam between a retracted position in which it is entirely outside of the sleeve and an extended position in which at least a portion thereof is inserted into the sleeve.

In accordance with an aspect of the invention, a toothed rack is mounted to the chassis opposite the ends of the rotatable loading floor. A pinion gear is mounted to the rotatable loading floor in mesh with the toothed rack. A motor mounted on the rotatable loading floor drives the pinion gear to swing the floor into a desired position. Even heavy loads carried on the rotatable loading floor can be handled with this arrangement because the torque applied is maximized due to the long torque arm between the gears and the pivot point of the floor.

DETAILED DESCRIPTION OF THE PREFERRED EMBODIMENTS

Figure 1:
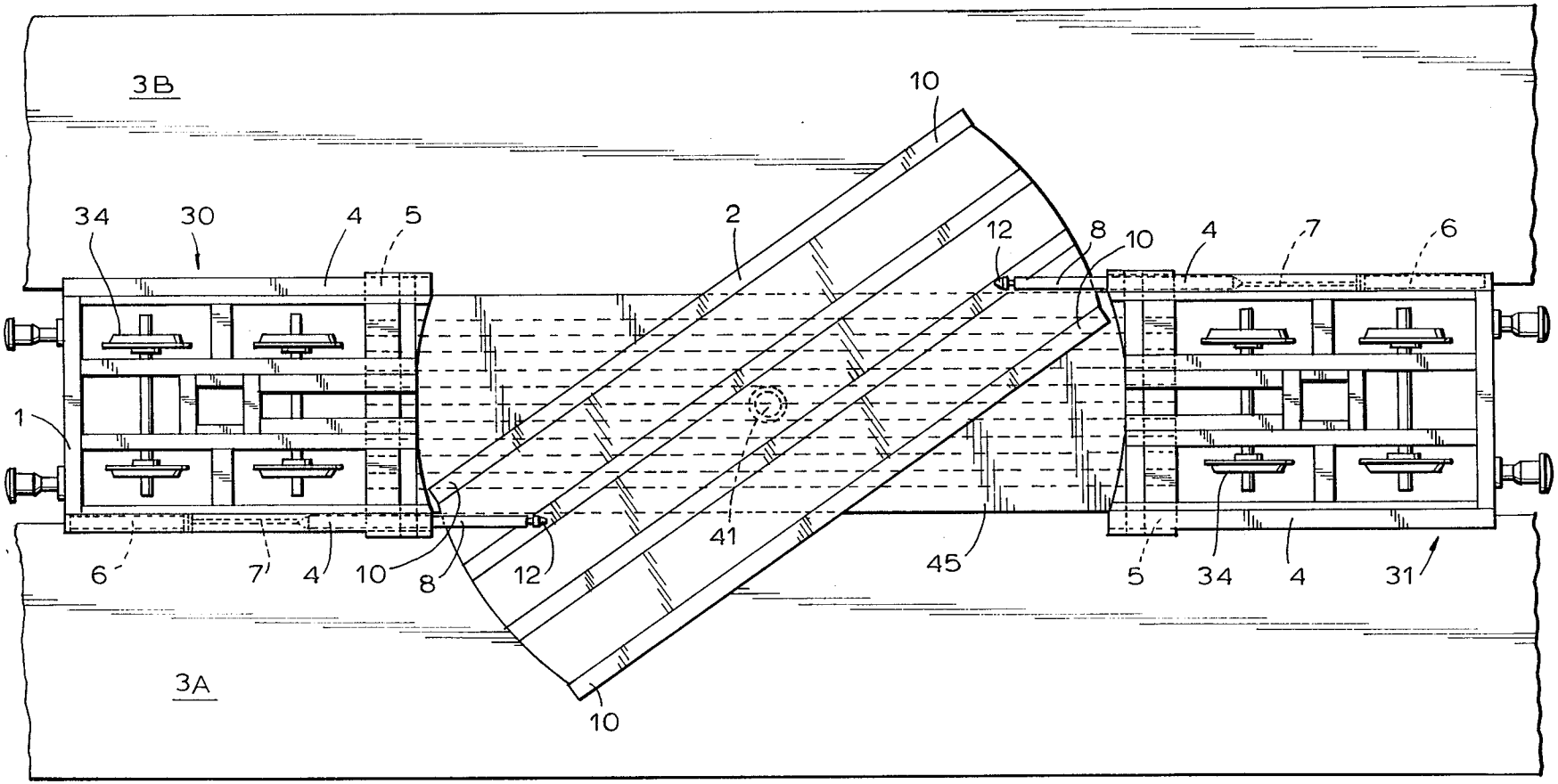
FIG. 1 is a top plan view of the rail car with the rotatable loading floor being shown in its rotated operative position overlying the station platform.
Figure 5:
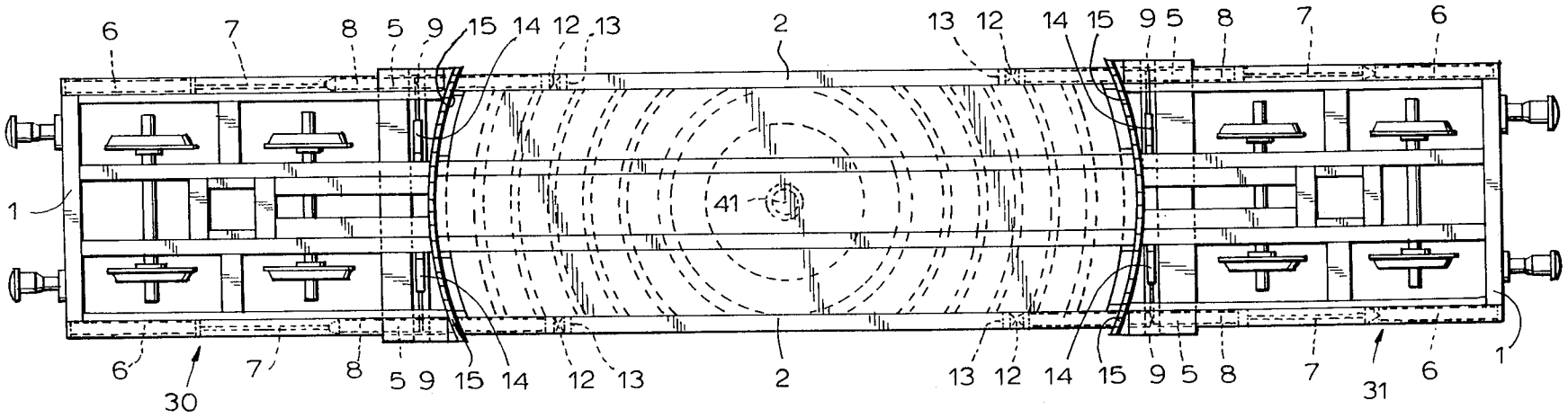
FIG. 5 is a top plan view of the rail car with the rotatable loading floor in its stowed position and secured to the chassis.
Figure 6:
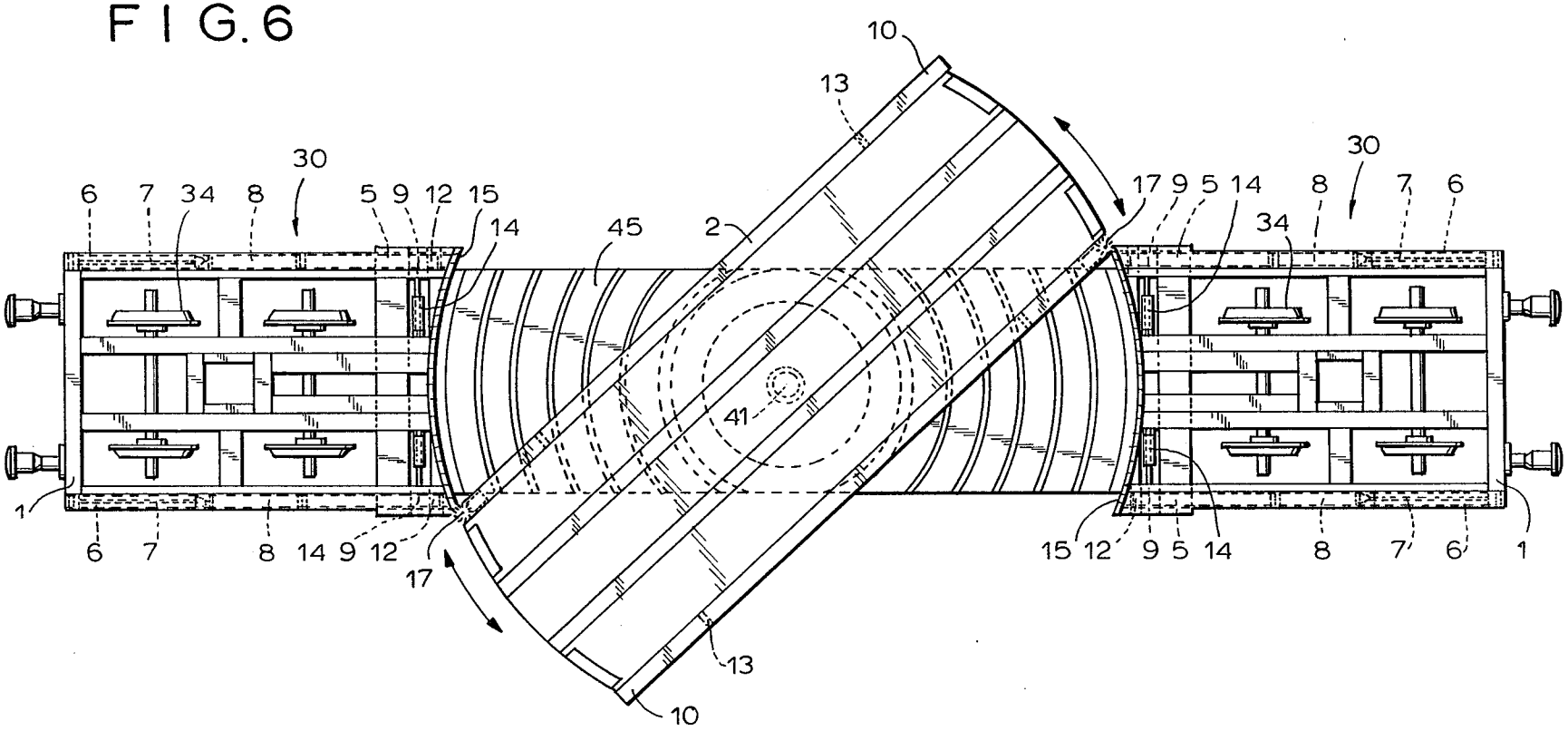
FIG. 6 is a top plan view like that of FIG. 5, but with the rotatable loading floor being unlocked from the chassis and rotated to its operative position.

As best shown in FIGS. 1, 5 and 6, rail car 1 includes a chassis with wheel support trucks 30 and 31 at its two ends. Wheels 34 are coupled to the wheel support trucks via a conventional suspension (not shown). The chassis also includes deck 45 located between and coupled to or integral with the wheel truck supports 30 and 31. Deck 45 is an elongated section which makes up much of the length of rail car 1 and above which the loads to be transported are carried.

Figure 2:
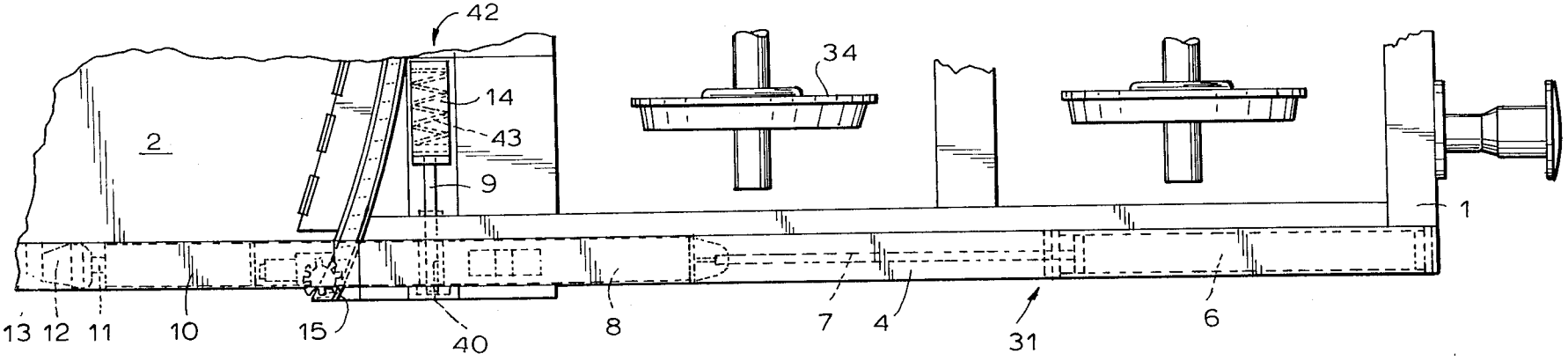
FIG. 2 is a fragmentary top plan view showing a wheel support truck and the rotatable loading floor, and showing structure in accordance with the invention to secure the floor in its stowed position as well as means to rotate the loading floor.

A rotatable loading floor 10 is pivotally coupled to deck 45 by axle 41 (FIG. 2). Rollers 15*a* (see FIG. 4) are provided between loading floor 10 and deck 45 to facilitate the rotational movement of loading floor 2 as described below. Rollers 15*a* are distributed in an equally spaced arrangement and coupled to each side of loading floor 10. For example, sixty such rollers can be provided on each side.

The rail car also includes gears for rotating the loading floor along with suitable motors for the gears. Furthermore, since rotatable loading floor 10 might become misaligned from its stowed position as a result of motion of the rail car, the loading floor must be secured to the chassis in order to prevent this from happening. An appropriate securing means is also, consequently, provided. In addition, a means for lifting the chassis to the height of the station platform is normally required because rail cars are constructed so that the chassis is typically lower than the station platform. Unless the chassis is raised, the station platform interferes with rotation of the loading floor into its operative position. Also, a control system for the motors, a securing means, and a lifting means are provided. U.S. Pat. No. 4,425,064 is hereby incorporated by reference as showing such a control system. It also shows the structure of the loading floor and axle pivot. A suitable lifting means for raising the height of the chassis as the rail car stands next to the station platform is also disclosed therein. The remaining above-mentioned elements, namely the gearing, motors, and securing means for the present invention are disclosed below.

The top-most portion of the wheel support trucks and the rotatable loading floor is a member 5 having a U-shape in its transverse cross section. The upwardly extending arms of this U-shaped member are formed as sleeves 4 with a square periphery of 200×200 mm. The wall thickness of sleeves 4 is 8 mm. These sleeves are open in the axial direction toward corresponding sleeves 10 on rotatable loading floor 2. When loading floor 2 is in its stowed position so that its longitudinal axis is aligned with the longitudinal axis of the chassis, sleeves 4 on wheel support trucks 30 and 31, and sleeves 10 on rotatable loading floor 2 are aligned so that their respective longitudinal axes coincide.

Turning now to FIG. 2, it depicts a fragmentary portion of wheel support truck 31 and rotatable loading floor 2 in its stowed position. As stated above, sleeve 10 on rotatable loading floor 2 is in precise alignment with its corresponding sleeve 4 on wheel support truck 31. Within sleeve 4 in wheel support truck 31 is secured a pneumatic cylinder 6 having a piston rod 7 extendible therefrom. The free end of piston rod 7 is coupled to beam 8. Beam 8 has a square transverse cross section of 180×180 mm., and its wall thickness is 8 mm. It slides within sleeve 4 as piston rod 7 is extended from or retracted into pneumatic cylinder 6. Pneumatic cylinder 6 is 1,700 mm. long and piston rod 7 has a stroke of 1,500 mm.

Beam 8 has a length of 2,800 mm. When piston rod 7 is fully retracted into pneumatic cylinder 6, beam 8 is received entirely within sleeve 4 of wheel support truck 31. As pneumatic cylinder 6 forcefully extends piston rod 7, beam 8 will be pushed into sleeve 10 on rotatable loading floor 2. This extension continues until the tapered member 12 at the free end of beam 8 engages plate 13 secured within sleeve 10. Plate 13 is made of steel with a thickness of 100 mm. and can, for example, be welded in place in order to provide the needed buffer strength, as discussed below. Steel plate 13 is located approximately 1,400 mm. inside sleeve 10, and, is sized to approximate the internal dimensions of sleeve 10. Member 12 is shaped in a taper in order to assist in guiding beam 8 into sleeve 10 even if a slight misalignment may exist between sleeve 10 and sleeve 4. It is adjustable relative to the body of beam 8 by means of a screw 11 so that it can be rotated in order to effectively lengthen or shorten the total length of beam 8 for a reason discussed below. When beam 8 is received in sleeve 10 so that it firmly abuts against plate 13, approximately 1,400 mm. of its length are accommodated within sleeve 10 while its remaining length, also approximately 1,400 mm. is retained within sleeve 4. In this position, a transverse opening 40 formed in beam 8 is aligned directly opposite a locking means 42. It includes a pin 9 sized to slidably fit within opening 40 of beam 8. Pin 9 is movable between extended and retracted positions by a cylinder 14. It includes a spring 43 which biases pin 9 into its extended position within opening 40 of beam 8. Since the position of locking means 42 and opening 40 are fixed, the adjustable tapered member 12 at the front end of beam 8 is needed to accommodate any necessary adjustments which may be required so that the locking means 42 can properly operate while beam 8 is still brought into firm engagement with steel plate 13.

Pneumatic cylinder 6 and cylinder 14 are operated by conventional power means. Specifically, hydraulic pressure is delivered to pneumatic cylinder 6, as needed, by standard and well known means which are not deemed necessary to be disclosed. Likewise, cylinder 14 can be operated by pneumatic or electrical means to attract pin 9 into the body of cylinder 14 against the biasing force of spring 43.

In operation, when rotatable loading floor 2 is in its stowed position on the chassis of rail car 1, it is readied for travel by firmly securing the loading floor to the chassis. This is done by actuating pneumatic cylinder 6 so that it extends its piston rod 7. As a consequence, beam 8 slides out of sleeve 4 until tapered front end 12 enters sleeve 10 on rotatable loading floor 2. Should a slight misalignment exists, the tapered front end of member 8 acts to guide the beam into sleeve 10. As extension of piston rod 7 by pneumatic cylinder 6 continues, beam 8 slides within sleeve 10 until tapered front end 12 firmly abuts against steel plate 13. Since opening 40 of beam 8 is now in alignment with locking means 42, pin 9 will have been extended under the biasing force of spring 43 into the beam 8.

In this position, several highly advantageous functions are performed by the apparatus just described above. Firstly, each abutment between beam 8 and plate 13 is designed to withstand a shearing force on plate 13 of 75 tons. Thus, in a rail car such as depicted in FIG. 5 with four arrangements such as those shown in detail by FIG. 2, a total buffer pressure of 300 tons can be withstood. This is 100 tons more than is prescribed by railway companies. Secondly, this arrangement is highly effective in preventing the accidental rotation of loading floor 10 from its stowed position during motion of rail car 1. Since beams 8 are received within both sleeves 4 and 10 on, respectively, a wheel support truck and the loading floor, this prevents the horizontal rotation of the loading floor. In addition, locking means 42 insures that beam 8 does not accidentally slide out of sleeve 10. Thirdly, beams 8 are also effective to stiffen the rail car and minimize sagging which may occur in the chassis due to heavy loads being carried on loading floor 2. Beams 8 and respective sleeves 4 and 10 are effective to provide a firm interconnection which distributes the transported load more evenly along the length of the chassis.

In order to release the rotatable loading floor 2 so that it can be placed in its operative position to overlie station platforms 3A and 3B, the means for retracting pin 9 into cylinder 14 against the bias of spring 43 is actuated. With pin 9 removed from hole 40 of each beam 8, pneumatic cylinder 6 is actuated to retract piston rod 7 and, thereby, withdraw beam 8 from sleeve 10. As soon as beam 8 starts moving and opening 40 is no longer aligned with pin 9, the means for actuating the retraction of pin 9 can be released and the front tip of pin 9 then simply rides along the side of beam 8. When beam 8 is fully retracted into sleeve 4, loading floor 2 is then free to be rotated into its operative position.

Figure 3:
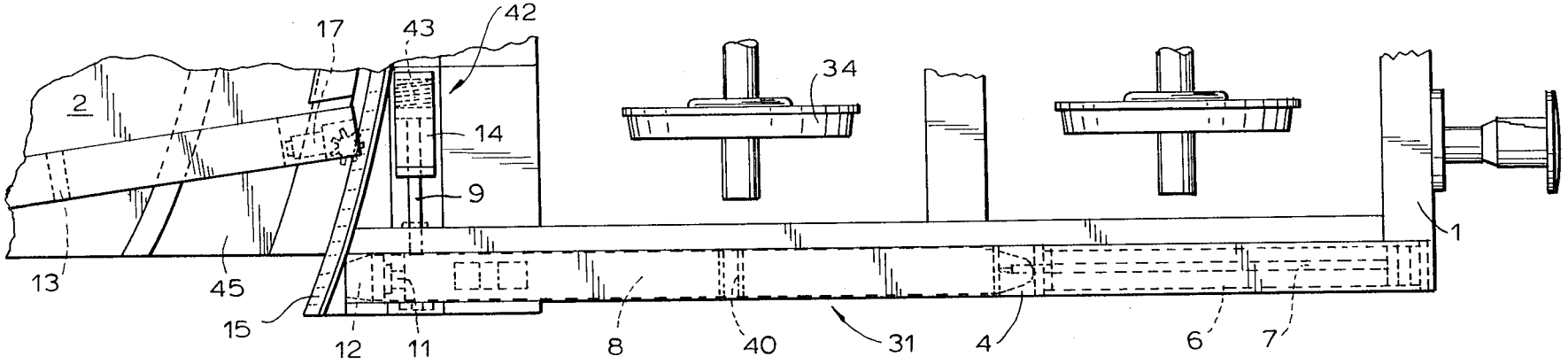
FIG. 3 is a fragmentary top plan view like that of FIG. 2, but with the loading floor being somewhat rotated away from its stowed position.
Figure 4:
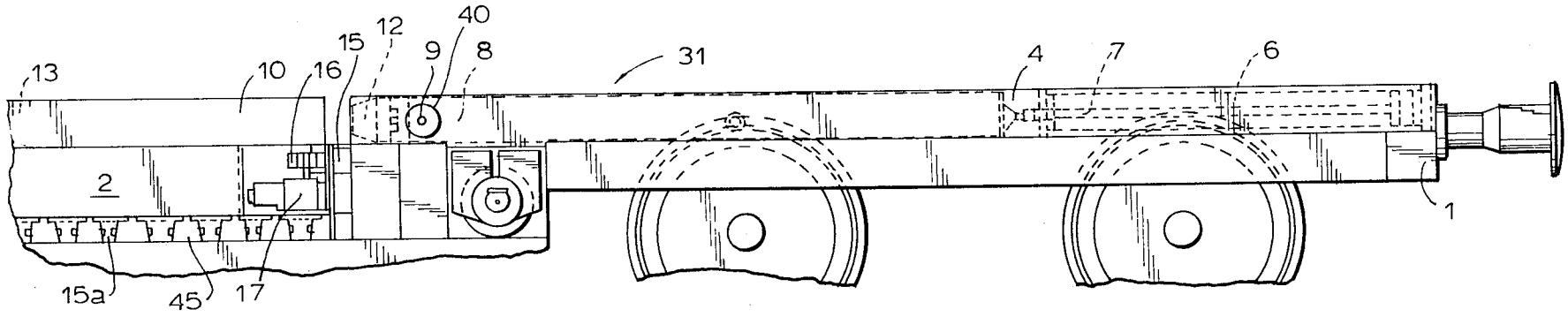
FIG. 4 is an elevational view of the fragmentary portion depicted in FIG. 3.

In accordance with another advantageous aspect of the present invention, a toothed rack 15 is provided on a face of wheel support truck 31 opposite rotating loading floor 2. This is best shown in FIGS. 2, 3 and 4. A pinion gear 16 is meshed with rack 15. Pinion gear 16 is mounted along with its motor 17 on rotatable loading floor 2. Motor 17 can be of the ballwheel brake engine-reducer type. As motor 17 is operated under power, it drives pinion gear 16 to turn it relative to rack 15. Consequently, rotatable loading floor 2 will be swung into desired position. As viewed in FIG. 3, when pinion gear 16 rotates in the clock-wise direction, rotatable loading floor 2 will be swung from its stowed position to its operative position overlying station platforms 3A and 3B. With pinion gear 16 being rotated in the counter clock-wise direction, rotatable loading floor 2 will be returned to its stowed position on the chassis of rail car 1.

As shown in FIG. 6, a combination of pinion gear 16 and driving motor 17 is preferably provided at two diagonal corners of rotatable loading floor 2. In this manner, each end of the rotatable loading floor will be positively driven to prevent the possibility of binding.

The driving arrangement just-described above is particularly advantageous in order to maximize the rotational torque that can be applied to rotatable loading floor 2. Because the driving means including rack 15, and pinion gear 16 are located at the outermost portions of rotatable loading floor 2 at the maximal distance from axle 42, the longest torque arm is utilized. Accordingly, even very heavy loads when carried on rotatable loading floor 2 will not interfere with the proper rotation of loading floor 2 into position.

Although a preferred embodiment of the present invention has been disclosed above, it is apparent that various modifications to it can readily be made. For example, the lifting means can also be that disclosed in commonly assigned copending application Ser. No. 110,095, filed, Oct. 15, 1987, titled Rail Car with Rotatable Floor for the Quick Loading and Unloading of Trailers. This and other such modifications are intended to fall within the scope of the present invention a defined by the following claims.

We claim:

1. In a rail car for use with a station platform located on a longitudinal side of said rail car for transferring loads between the rail car and said station platform, said rail car having a chassis supported by wheels, said chassis including a deck coupled between chassis end portions; an elongated loading floor pivotally mounted on said deck and being rotatable relative to said chassis in a substantially horizontal plane between first and second positions, said first position being a position in which the longitudinal axis of the loading floor coincides with the longitudinal axis of the rail car, and said second position being a position in which at least one end of said loading floor overlies said station platform at the side of the rail car in operative association with the station platform for transferring a load between the loading floor and the station platform; and means for rotating the loading floor between said first and second positions; the improvement comprising means to secure the loading floor to the chassis when said loading floor is in its first position, including;

a sleeve secured to said rotatable loading floor, said sleeve having its axis parallel to the longitudinal axis of the rail car when the rotatable loading floor is in its first position, a beam slidably mounted to at least one of said chassis end portions, said beam having its axis substantially coinciding with the sleeve axis when the rotatable loading floor is in the first position, said beam being sized to slidably fit into said sleeve, power means to move said beam between a retracted position in which it is entirely outside of said sleeve and an extended position in which at least a portion thereof is inserted into said sleeve;

a plate secured transversely in said sleeve, said beam firmly bearing against said plate in the extended position;

length adjustment means at the end of said beam for adjusting the length of said beam until it firmly bears against said plate in the extended position to structurally stiffen the rail car; and wherein said locking means comprises a pin mounted on the one of said rotatable loading floor and at least one of said chassis end portions with its axis being substantially perpendicular to said sleeve axis, an opening in said beam aligned with the pin axis when the beam is in its extended position and sized to slidably receive said pin therein, and actuating means to move said pin between a retracted position in which it is entirely outside of said beam opening and an extended position in which it is received within said beam opening.

2. The rail car of claim 1, further comprising a locking means to lock the beam in its extended position.

3. The rail car of claim 2, wherein said chassis end portions comprise wheel support trucks fore and aft of said deck.

4. The rail car of claim 3, wherein said beam is slidably secured to a wheel support truck.

5. The rail car of claim 4, wherein said beam is slidably secured to a longitudinal side of said wheel support truck adjacent to said rotatable loading floor, and the sleeve is secured on the rotatable loading floor opposite and adjacent to said beam.

6. The rail car of claim 5, wherein four sleeve and beam combinations are, respectively, at the four corners of the rotatable loading floor.

7. The rail car of claim 5, wherein said motor means includes a pneumatic cylinder having a piston rod connected to said beam, said pneumatic cylinder being mounted on the wheel support truck.

* * * * *